US005512992A

United States Patent [19]

Kim et al.

[11] Patent Number: 5,512,992

[45] Date of Patent: Apr. 30, 1996

[54] APPARATUS AND METHOD FOR CONTROLLING FUSING TEMPERATURE

[75] Inventors: Seong-Ho Kim, Seoul; Joong-Ki Kwon, Kyungki-do, both of Rep. of Korea

[73] Assignee: SamSung Electronics Co., Ltd., Kyungki-do, Rep. of Korea

[21] Appl. No.: 252,003

[22] Filed: May 31, 1994

[30] Foreign Application Priority Data

May 31, 1993 [KR] Rep. of Korea ..... 9532-1993
Dec. 31, 1993 [KR] Rep. of Korea ..... 31805-1993

[51] Int. Cl.[6] ..... G03G 15/20

[52] U.S. Cl. ..... 355/285; 355/208; 355/282; 219/216

[58] Field of Search ..... 355/282, 285, 355/289, 290, 295, 208; 219/216

[56] References Cited

U.S. PATENT DOCUMENTS

| | | | |
|---|---|---|---|
| 3,053,962 | 9/1962 | Cerasani et al. . | |
| 3,795,787 | 3/1974 | Nogaito et al. . | |
| 3,926,519 | 12/1975 | Rebres . | |
| 3,989,926 | 11/1976 | Yoshizawa et al. . | |
| 4,349,269 | 9/1982 | Okada . | |
| 4,373,801 | 2/1983 | Itoh . | |
| 4,439,143 | 3/1984 | Hanamoto et al. . | |
| 4,549,803 | 10/1985 | Ohno et al. . | |
| 4,634,262 | 1/1987 | Imaizumi et al. . | |
| 4,719,489 | 1/1988 | Ohkubo et al. . | |
| 4,822,977 | 4/1989 | Leising et al. . | |
| 4,835,573 | 5/1989 | Rohrer et al. . | |
| 5,099,287 | 3/1992 | Sato . | |
| 5,115,279 | 5/1992 | Nishikawa et al. | 355/290 |
| 5,307,134 | 4/1994 | Nakajima et al. . | |
| 5,319,428 | 6/1994 | Maruko et al. | 355/290 |
| 5,351,114 | 9/1994 | Matsuno | 355/285 |
| 5,374,983 | 12/1994 | Isogai | 219/216 X |

FOREIGN PATENT DOCUMENTS

| | | |
|---|---|---|
| 0059480 | 5/1980 | Japan . |
| 0059481 | 5/1980 | Japan . |
| 0099373 | 8/1981 | Japan . |
| 0045576 | 3/1982 | Japan . |
| 0044171 | 3/1982 | Japan . |
| 0155575 | 9/1982 | Japan . |
| 0022163 | 2/1985 | Japan . |
| 0088571 | 4/1989 | Japan . |
| 0300282 | 12/1989 | Japan . |
| 0053093 | 2/1990 | Japan . |
| 0120781 | 5/1990 | Japan . |
| 0208077 | 9/1991 | Japan . |
| 0016889 | 1/1992 | Japan . |
| 0134459 | 5/1992 | Japan . |
| 0166853 | 6/1992 | Japan . |
| 0168469 | 6/1992 | Japan . |
| 0165365 | 7/1993 | Japan . |
| 0297763 | 11/1993 | Japan . |

*Primary Examiner*—Matthew S. Smith
*Attorney, Agent, or Firm*—Robert E. Bushnell

[57] ABSTRACT

An apparatus for controlling a fusing temperature in a system using an electrophotographic developing process by sensing the thickness of the paper. An apparatus for controlling a fusing temperature in a system using an electrophotographic developing process having a fusing lamp for generating heat to execute a fusing operation, a fusing temperature detecting device for generating a detection value according to the change of the fusing temperature of a heat roller, a sensing device for discriminating the kind of the paper according to the detection of the thickness of a conveyed paper, a controller for comparing a value set according to the kind of the paper discriminated from the sensing device with the detection value detected by the fusing temperature detecting device to thereby generate a control signal controlling driving of the fusing lamp to control the fusing temperature, and device for driving the fusing lamp in response to the control signal.

20 Claims, 7 Drawing Sheets

APPARATUS AND METHOD FOR CONTROLLING FUSING TEMPERATURE

BACKGROUND OF THE INVENTION

The present invention relates to an apparatus for controlling fusing temperature in an electrographic developing system, and more particularly, to an apparatus and method for controlling fusing temperature at the touch of a key in accordance with the thickness of the paper.

Generally electrophotographic developing systems consist of a laser beam printer, an electrophotographic copying machine or the like. The operation of the laser beam printer is disclosed in Korean Patent application No. 92-11243. In such a printer, the toner attached to recording paper by the developing process is fused to the paper by a fusing device. The fusing device utilizes a heated heat roller and a pressing roller. The heat provided by the heat roller is generated from a fusing lamp installed in the interior of the heat roller. The fusing temperature, or temperature of the heat produced by the heat roller, is determined by the heat generated from the fusing lamp. Consequently, when recording paper is jammed in the fusing device, high fusing temperature may cause the jammed paper to catch fire. Alternatively, if the fusing temperature is too low, the toner may not be properly fused to the recording paper.

A conventional apparatus for controlling fusing temperature incorporates a temperature sensing device, a set temperature control device, a CPU and a fusing lamp driving device. The temperature sensing device consists of a thermistor, a resistor and a variable resistor, for generating a temperature sensing voltage in accordance with the fusing temperature and changes in fusing temperature. The set temperature control device consists of a comparator for comparing the temperature sensing voltage of the temperature sensing device with a temperature set voltage produced by a pair of resistors, and a feedback resistor connected to a terminal and the output terminal of a comparator. The CPU receives the set temperature control signal outputted from the set temperature control device to generate a fusing temperature control signal. The fusing lamp driving device consists of a group of resistors, a phototriac, a transistor and capacitors for driving a fusing lamp in response to the fusing temperature control signal outputted from the CPU.

The set temperature control device controls the fusing temperature according to a set temperature corresponding to the temperature set voltage provided by the resistors. The set temperature is fixed regardless of the kind of the paper. Therefore, when the temperature sensing voltage of the temperature sensing device, which senses the heating temperature of the fusing lamp, is over the set temperature produced by the resistors, the output of the comparator shifts. At this time, the CPU turns off the transistor, thereby disabling the phototriac.

When the phototriac is turned off, the power supply of the fusing lamp is cut off. Consequently, the fusing lamp is no longer heated and the fusing temperature drops. After the fusing lamp remains off for a period of time, the temperature sensing voltage drops below the set temperature corresponding to the temperature set voltage, rendering the comparator to again shift its output or set temperature control signal. At this time, the CPU turns on the transistor and the phototriac. When the phototriac is turned on, the fusing lamp starts to generate heat to raise the fusing temperature. If it is not necessary to control the fusing temperature, the CPU disables the power supply to the fusing lamp.

In addition to the conventional apparatus explained above, other apparatus for controlling fusing temperature exist.

Itoh, U.S. Pat. No. 4,373,801 entitled Fixing Temperature Selecting Control in a Copying Machine, discloses a device which controls fusing temperature according to the thickness of a sheet of paper. Two manual switches disposed upon the device produce signals which change the fusing temperature for a thick sheet of paper or a thin sheet of paper. The device also contains two inlets. One for receiving thin paper and one manual inlet for receiving thick paper.

Hanamoto et al., U.S. Pat. No. 4,439,143 entitled Heat Rolling Fixing Device, discloses a fixing device which varies temperature according to the thickness of copy paper. This device merely switches between two fusing temperatures, one temperature for thick copy paper and one temperature for normal copy paper. These respective temperatures are obtained by activation of a manual switch disposed upon the device.

Nakajima et al., U.S. Pat. No. 5,307,134 entitled Electrophotographic Apparatus, discloses a fixing device wherein the fixing temperature can be changed in accordance with the thickness of a sheet of paper. This device utilizes two paper paths to distinguish between a normal sheet of paper and a thick sheet of paper. Accordingly, the user must enter a sheet of paper into one of the two paper paths and the device changes fixing temperature according to the guide path which the paper travels through.

Rohrer et al., U.S. Pat. No. 4,835,573 entitled Machine Control System Utilizing Paper Parameter Measurements, discloses a method and apparatus for calculating sheet thickness. This method and apparatus uses a "sheet quality factor" determined by dividing the amount in height a stack of paper changes in response to withdrawal therefrom of a predetermined number of sheets. After the "sheet quality factor" is determined and the thickness of the sheets are obtained, the device suggests adjusting the temperature of the image fuser correspondingly.

In the conventional apparatus for controlling fusing temperature, the fusing temperature is maintained at a constant level. Consequently, when fusing toner to a thin sheet of paper at an excessively high temperature, the paper may be crumpled when ejected, catch on a heat roller, or jam during the printing operation. Alternatively, when fusing toner to a thick sheet of paper, the fusing operation is not normally completed since the temperature in the heat roller becomes drastically lower due to loss of heat caused by the thickness of the sheet of paper.

Moreover, the conventional apparatus which attempt to control fusing temperature do not calculate the actual thickness of each sheet of paper in order to properly control the fusing temperature of the fusing device. These devices utilize either a manual method of determining the thickness of the sheet of paper or a method which determines average sheet thickness by calculating "a sheet quality factor". Additionally, these devices only contemplate temperature variations for two thickness. Consequently, wide variations of paper thickness must be termed either thick or normal and the fusing temperature set accordingly. This may still result in the aforementioned problems of paper crumpling or inadequately fusing the toner to the paper in the case of overly thin sheets of paper and overly thick sheets of paper.

SUMMARY OF THE INVENTION

It is therefore one object of the present invention to provide an apparatus and method for controlling fusing temperature for the purpose of solving the problems discussed above.

It is another object of the present invention to provide an apparatus for controlling fusing temperature value in accordance with input of a key which selects the fusing temperature corresponding to the thickness of the paper in a system using an electrophotographic developing process.

It is still another object of the present invention to provide an apparatus and method for controlling fusing temperature by sensing the thickness of the paper in a system using an electrophotographic developing process.

It is a further object of the present invention to provide an apparatus and method for controlling fusing temperature with a set temperature corresponding to the thickness of the paper in a system using an electrophotographic developing process.

To achieve these and other objects, a method for controlling a fusing temperature in the present invention comprises the steps of discriminating the thickness of the paper when the paper is fed after setting a preheating temperature, and controlling fusing temperature as a set temperature corresponding to the paper discriminated in the step above by sensing the fusing temperature after discriminating the thickness of the paper.

To achieve these and other objects, an apparatus for controlling a fusing temperature in the present invention comprises a key input device for generating key signals for setting a fusing temperature out of multiple fusing temperatures, a fusing temperature detecting device for generating a detection voltage according to the fusing temperature and the changes in the fusing temperature of a heat roller, a controller for controlling the printing operation in response to a key start signal inputted from the key input device and for responding to the key signals for setting the fusing temperature to thereby generate a control signal for controlling the fusing temperature value corresponding to the thickness of the paper, a set temperature converting device for converting a set temperature voltage after being switched by the control signal for controlling the fusing temperature value having the multi-step value outputted from the controller, a set temperature sensing device for comparing the temperature sensing voltage of the temperature detecting device with the temperature set voltage outputted from the set temperature converting device to thereby generate a signal for sensing the arrival of a set temperature to the controller, and a fusing lamp driving device for inputting the control signal for controlling the fusing temperature to thereby drive a fusing lamp.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, wherein.

DETAILED DESCRIPTION OF THE PREFERRED EMBODIMENT

Figure 1:
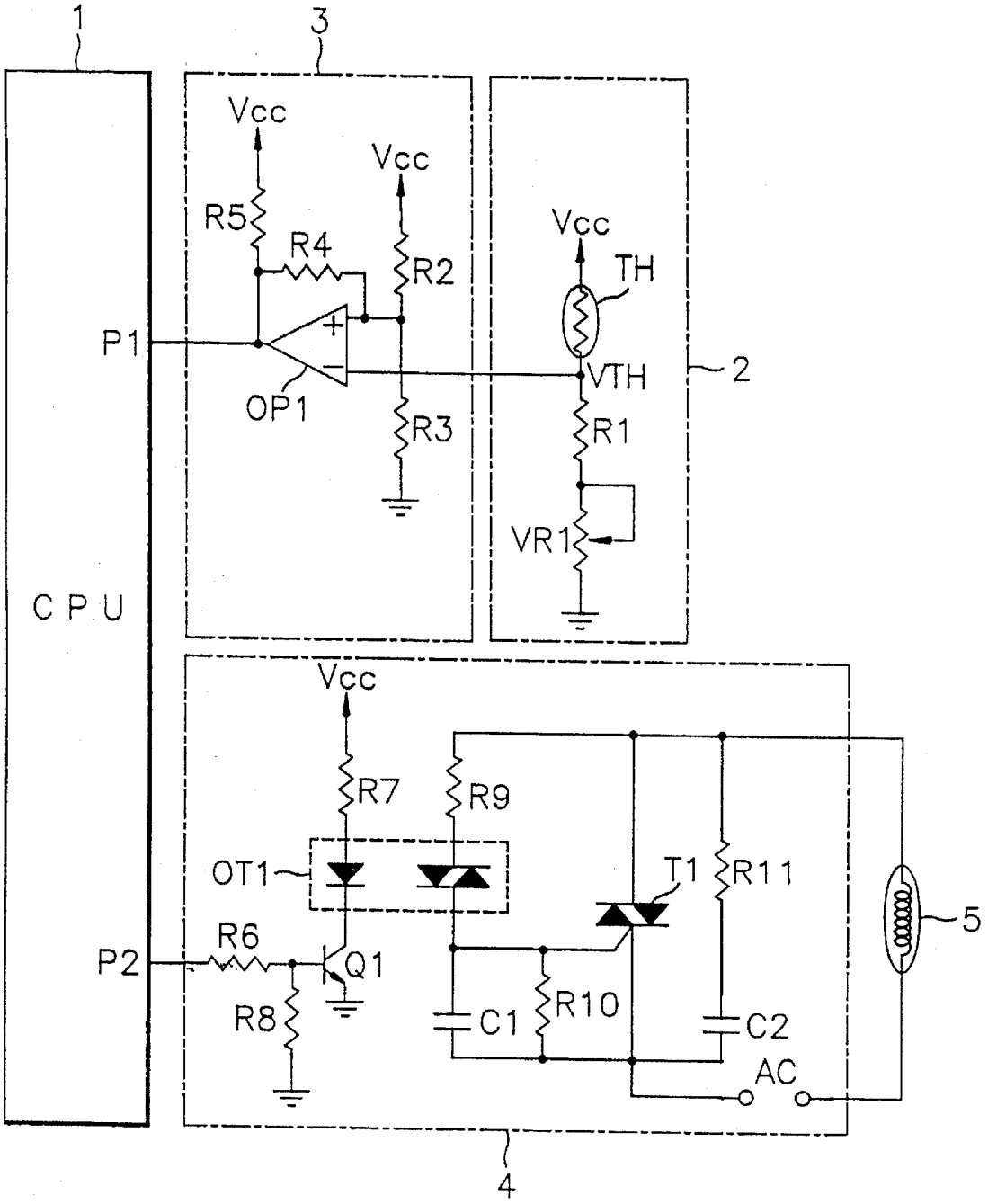
FIG. 1 is a circuit diagram showing a conventional apparatus for controlling fusing temperature.

FIG. 1 is a circuit diagram of a conventional apparatus for controlling fusing temperature. The circuit of FIG. 1 comprises a temperature sensing device 2, a set temperature control device 3, a CPU 1 and a fusing lamp driving device 4. Temperature sensing device 2 uses of a thermistor TH, a resistor R1 and a variable resistor VR1, for generating a temperature sensing voltage $V_{TH}$ in accordance with the fusing temperature and changes of fusing temperature. Set temperature control device 3 has a comparator OP1 for comparing the temperature sensing voltage $V_{TH}$ of the temperature sensing device 2 with a temperature set voltage $V_s$ produced by resistors R2 and R3, and a feedback resistor R4 connected to a positive terminal (+) and the output terminal of OP1. CPU 1 receives a set temperature control signal produced by the set temperature control device 3 to generate a fusing temperature control signal. Fusing lamp driving device 4 relies upon resistors R6 to R8, a phototriac OT1, a transistor Q1, capacitors C1 and C2, and resistors R9 to R11, for driving a fusing lamp 5 in response to the fusing temperature control signal outputted from the CPU 1.

Explanation of the conventional operation for controlling fusing temperature will be hereinafter given with regard to FIG. 1.

The set temperature control device 3 controls the fusing temperature according to a set temperature corresponding to the temperature set voltage Vs provided by resistors R2 and R3. The set temperature is fixed regardless of the kind of the paper. Therefore, when the temperature sensing voltage $V_{TH}$ of the temperature sensing device 2, which senses the heating temperature of the fusing lamp 5, is over the set temperature produced by resistors R2 and R3, the output of the comparator OP1 shifts to a low level. At this time, CPU 1 outputs a low signal through second output port P2 and turns off the transistor Q1, thereby disabling the phototriac OT1.

When the phototriac OT1 is turned off, the AC power supply of the fusing lamp 5 is cut off. Consequently, the fusing lamp 5 is no longer heated and the fusing temperature drops. After the fusing lamp 5 remains off by a period of time, the temperature sensing voltage $V_{TH}$ drops below the set temperature corresponding to the temperature set voltage $V_s$ by resistors R2 and R3, thus rendering the comparator OP1 to produce a high output or set temperature control signal. At this time, the CPU 1 generates a logic high signal to the second output port P2 and turns on the transistor Q1 and the phototriac OT1. When the phototriac OT1 is turned on, the fusing lamp 5 starts to generate heat to raise the fusing temperature. If it is not necessary to control the fusing temperature, the CPU 1 generates a logic low signal to the second output port P2, disabling the power supply to the fusing lamp 5.

Figure 2:
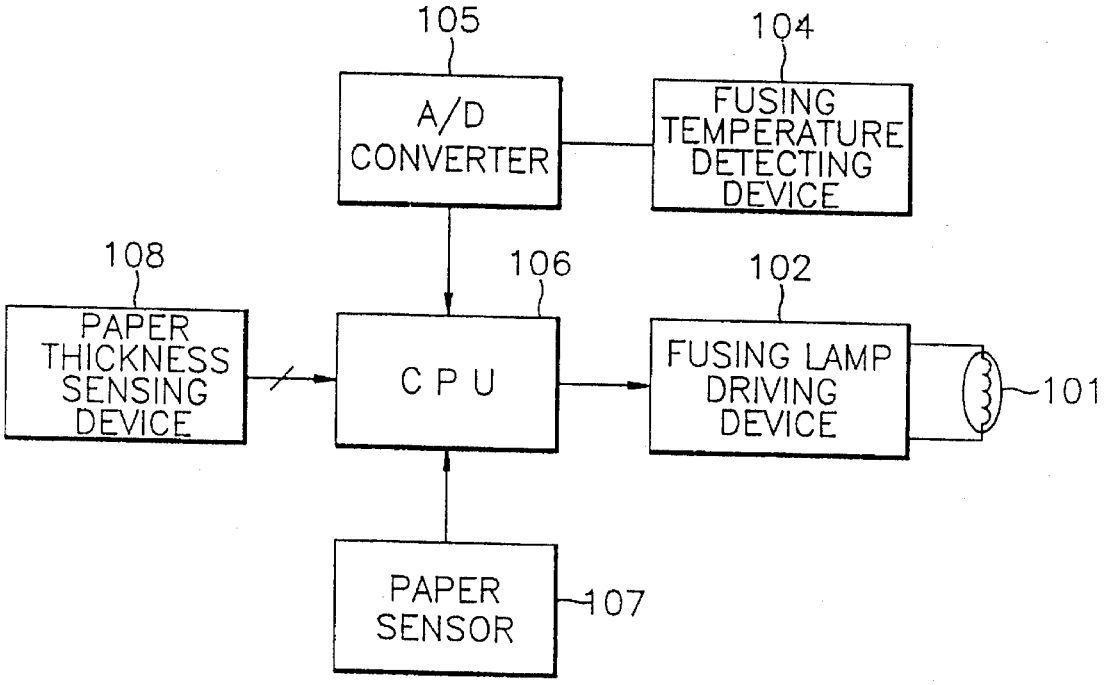
FIG. 2 is a block diagram showing an apparatus for controlling fusing temperature according to an embodiment of the present invention.

FIG. 2 is a block diagram of an apparatus for controlling fusing temperature according to an embodiment of the present invention. A fusing lamp 101 generates heat utilized in the execution of the fusing operation. Fusing lamp driving device 102 drives the fusing lamp 101, so fusing lamp 101 generates heat. A fusing temperature detecting device 104 installed at a heat roller generates a detection voltage $V_0$ representing the fusing temperature, and consequently, any changes in fusing temperature. Analog/digital converter 105 converts the detection voltage $V_0$ to digital data. Paper thickness sensing device 108 for determines the type of paper according to the detection of the thickness of the paper. CPU 106 compares the digital-converted data according to the type of paper with a predetermined value to generate a control signal to control the fusing lamp driving device 102 by turning the fusing lamp driving device "on" and "off", to thereby control the fusing temperature. Finally paper sensor 107 detects the paper conveyance or positional state of the paper to apply the state to the CPU 106.

In the embodiment shown in FIG. 2 the analog/digital converter 105 is installed in the interior of the CPU 106 or in the fusing temperature detecting device 104.

Figure 3A:
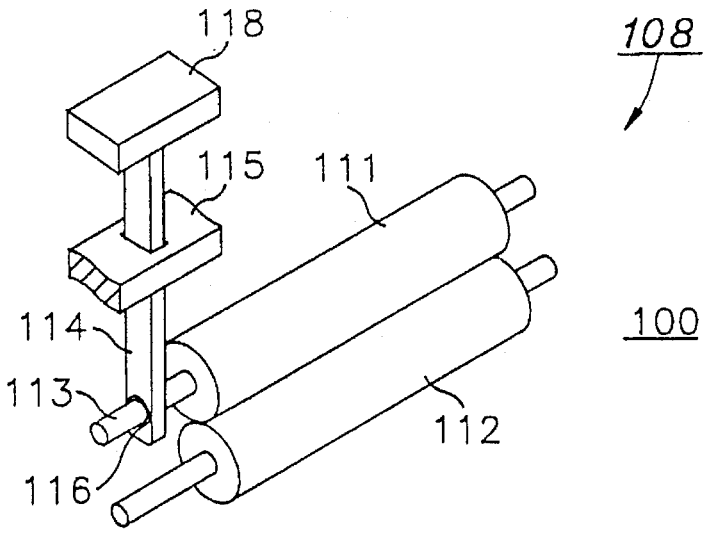
FIG. 3A and 3B are diagrams; showing a sensing device for sensing the thickness of a sheet of paper.
Figure 3B:
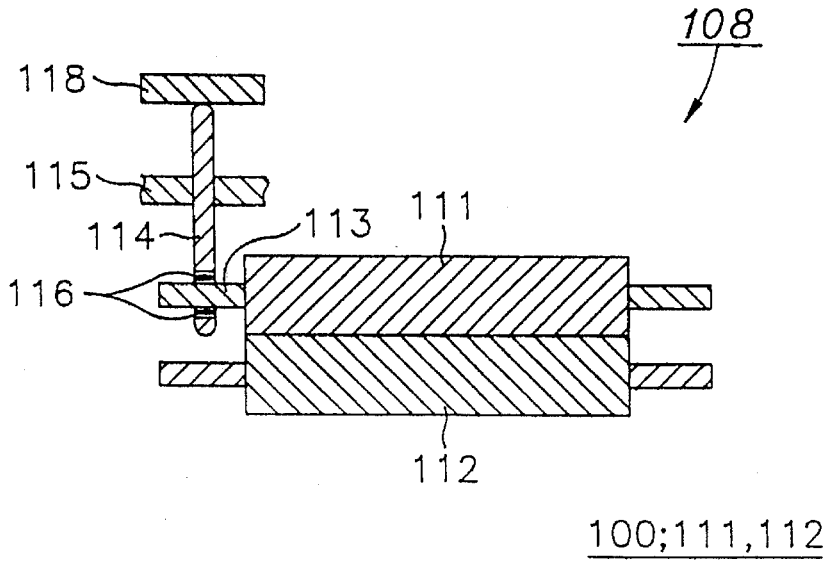

Referring now to FIG. 3A and 3B a paper thickness sensing device, which senses the thickness of a sheet of paper for determining the type of paper according to the present invention is generally shown at 108. Registration rollers 100, consisting of upper roller 111 and lower roller 112, register a sheet of paper being fed through the fusing device. The rotating axis 113 of an upper roller 111 is inserted into a bearing 116. A pushing bar 114 is disposed on the rotating axis 113 of the upper roller 111 and through pushing bar guide 115, at a right angle with the rotating axis 113. Consequently, the pressure exerted is converted in accordance with the thickness of the paper fed to the registration rollers 100, and a pressure sensing sensor 118 installed at the top portion of the pushing bar 114 for sensing the pressure exerted generates a paper thickness sensing signal representing the thickness of the paper.

Now, the operation for controlling fusing temperature with the preferred embodiment of the present invention will be explained in detail with reference to FIGS. 2 through 4B.

Figure 4A:
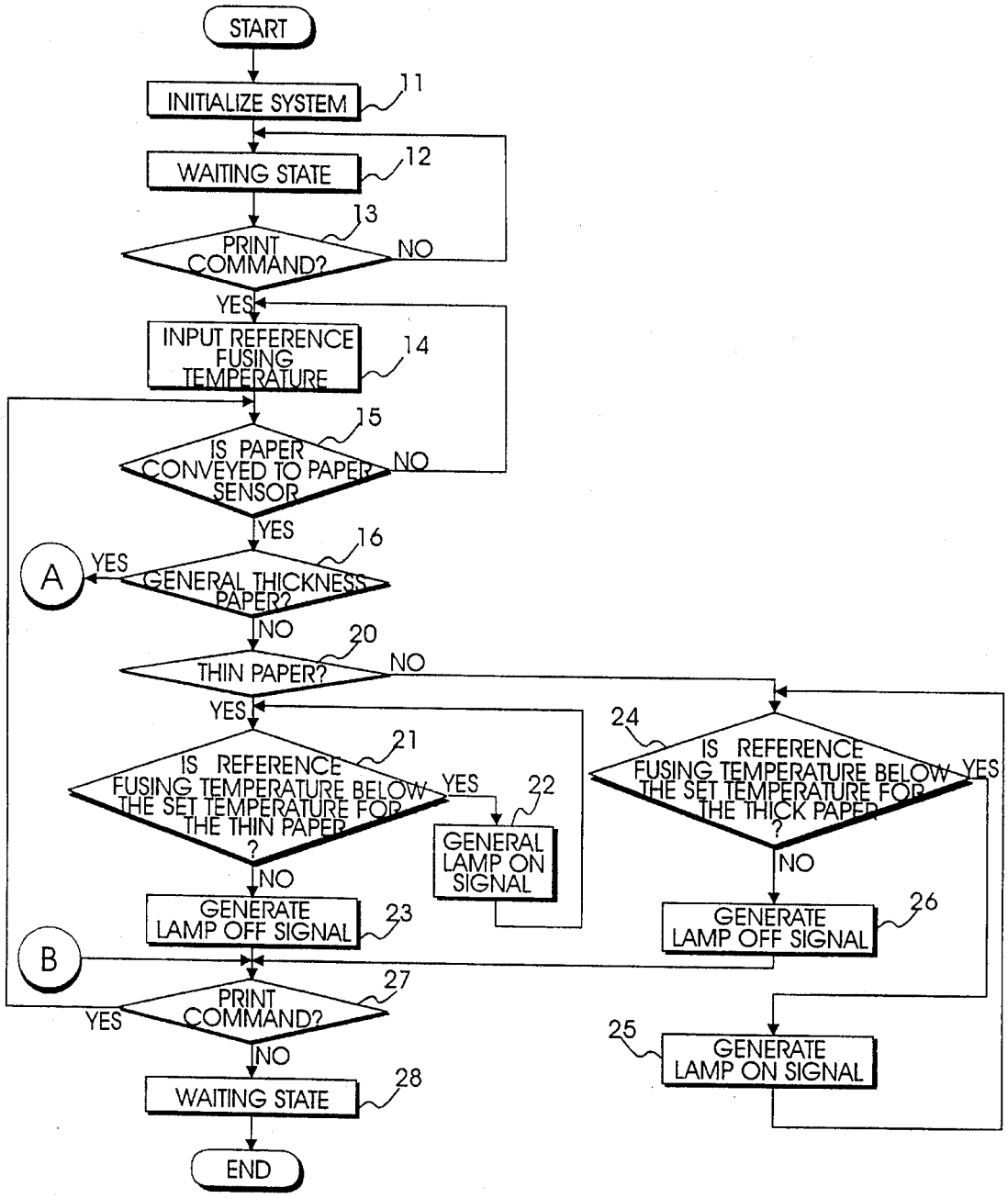
FIG. 4A and 4B are flowcharts showing the fusing temperature control process according to an embodiment of the present invention.
Figure 4B:
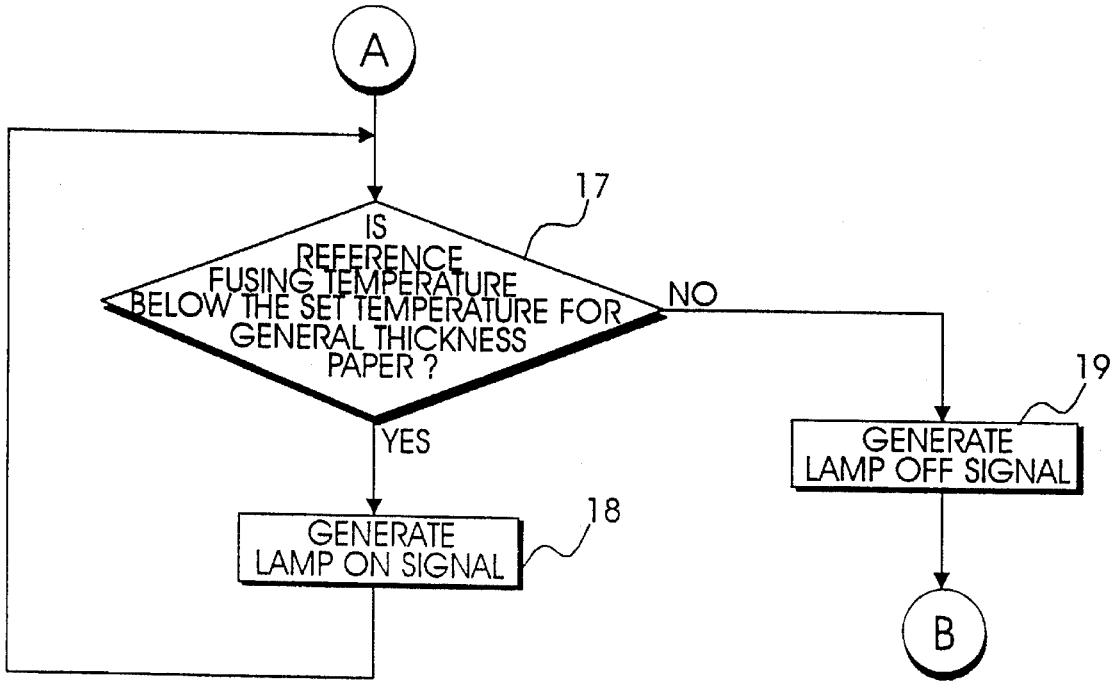

Referring now to FIGS. 4A and 4B the CPU 106 initializes the system at step 11. Then, at step 12, the CPU 106 puts the system in a waiting state. At step 13, the CPU 106 determines whether a print command has been issued. Once a print command is issued, the CPU 106 produces an adjusting temperature of the fusing device as a reference fusing temperature previously set and retrieved from an internal memory of CPU 106. The reference fusing temperature may be a set temperature for a general thickness sheet of paper or for the thickness of a previously fused sheet of paper. Thereafter, at step 15, the CPU 106 determines whether paper is fed to the paper sensor 107. Once a sheet of paper is fed to paper sensor 107, the CPU 106 determines if the sheet of paper is general thickness paper through the pressure sensing sensor 118 of the paper thickness sensing device 108, at step 16. If paper thickness sensing device 108 determines the paper is general thickness paper, the CPU 106 proceeds to step 17. At step 17, the CPU 106 determines if the set reference fusing temperature is below a set temperature for general thickness paper. If the reference fusing temperature is below the set temperature for general thickness paper, the CPU 106 generates a lamp on signal for turning on the fusing lamp 101 at step 18. Consequently, the fusing lamp 101 is turned on. Thereafter, the CPU 106 returns to the step 17 and continues to keep the fusing lamp 101 on until the reference fusing temperature is equivalent to the set temperature for general thickness paper so as to enable printing at the set temperature for general thickness. If the reference fusing temperature is over the set temperature for general thickness paper, the CPU 106 generates a lamp off signal for turning off the fusing lamp 101 at step 19. Consequently, the fusing lamp 101 is turned off so as to adjust the reference fusing temperature for printing at the set temperature for general thickness paper. At step 16, however, if the paper is not general thickness paper, the CPU 106 proceeds to step 20 to determine if the paper is thin paper. If it is thin paper, the CPU 106 proceeds to step 21. At the step 21, the CPU 106 determines if the reference fusing temperature is below a set temperature for the thin paper. If the reference fusing temperature is below the set temperature for thin paper, the CPU 106 generates a lamp on signal for turning on the fusing lamp 101 at step 22. Consequently, the fusing lamp 101 is turned on so as to adjust the reference fusing temperature for printing at the set temperature for thin paper. The CPU 106 returns to step 21 and the fusing lamp 101 remains on until the reference fusing temperature is over the set temperature for thin paper. Once the detected fusing temperature becomes the set temperature for thin paper, the CPU 106 generates a lamp off signal for turning off the fusing lamp 101 at step 23. Consequently, the fusing lamp 101 is turned off so as to enable printing at the set temperature for thin paper. If, on the hand, the detected reference fusing temperature is over the set temperature for thin paper at step 21, the fusing lamp 101 is turned off at step 23 so as to adjust the reference fusing temperature for printing at the set temperature for thin paper.

At the step 20, if the paper is not thin paper, but is thick paper, the CPU 106 proceeds to step 24 to determine if the reference fusing temperature is below the set temperature for the thick paper. If the reference fusing temperature is below the set temperature for thick paper, the CPU 106 generates a lamp on signal for turning on the fusing lamp 101 at step 25. Consequently, the fusing lamp 101 is turned on so as to adjust the reference fusing temperature for printing at the set temperature for thick paper. The CPU 106 returns to step 24 and the fusing lamp 101 remains on until the detected fusing temperature is over the set temperature for thick paper. Once the reference fusing temperature becomes the set temperature for thick paper, the CPU 106 generates a lamp off signal for turning off the fusing lamp 101 at step 26. Consequently, the fusing lamp 101 is turned off so as to enable priming at the set temperature for thick paper. If, however, the reference fusing temperature is over the set temperature for thick paper at step 24, the fusing lamp 101 is turned off at step 25 so as to adjust the reference fusing temperature for printing at the set temperature for thick paper. Thereafter, at step 27, the CPU 106 determines if a next print command is issued. If there is the next print command, the CPU 106 returns to the step 15 to repeat the operations mentioned above relying on a temperature of a previously fused sheet of paper as an input reference fusing temperature for a next sheet of paper. However, if there is no further print command, the CPU 106 proceeds to step 28 to enter into a waiting state.

The operation of the paper thickness sensing device 108, which senses the thickness of the paper with the pressure sensing sensor 118 and registration rollers 100, will be explained in detail with reference to FIGS. 3A and 3B.

When paper passes through the registration rollers 100, the rotating axis 113 of the upper roller 111 and the bearing 116 are rotated as one. In accordance with the thickness of the paper, the upper roller 111 is deflected or urged in an upward direction away from the lower roller 112. Consequently, the pushing bar 114 installed at the rotating axis 113 of the upper roller 111 at a right angle to rotating axis 113 gets pushed in the upward direction with the upper roller and the bearing 110, thereby providing pressure onto pressure sensing sensor 118. As a result, the pressure sensing sensor 118 senses the pressure transferred by the pushing bar 114 to determine the thickness of the paper.

Examples of three steps of adjusting the fusing temperature according to the thickness of the paper are considered in an embodiment of the present invention. However, it is possible that adjustment of the fusing temperature over three steps by putting more steps for determining the kind of paper in FIG. 2.

Figure 5:
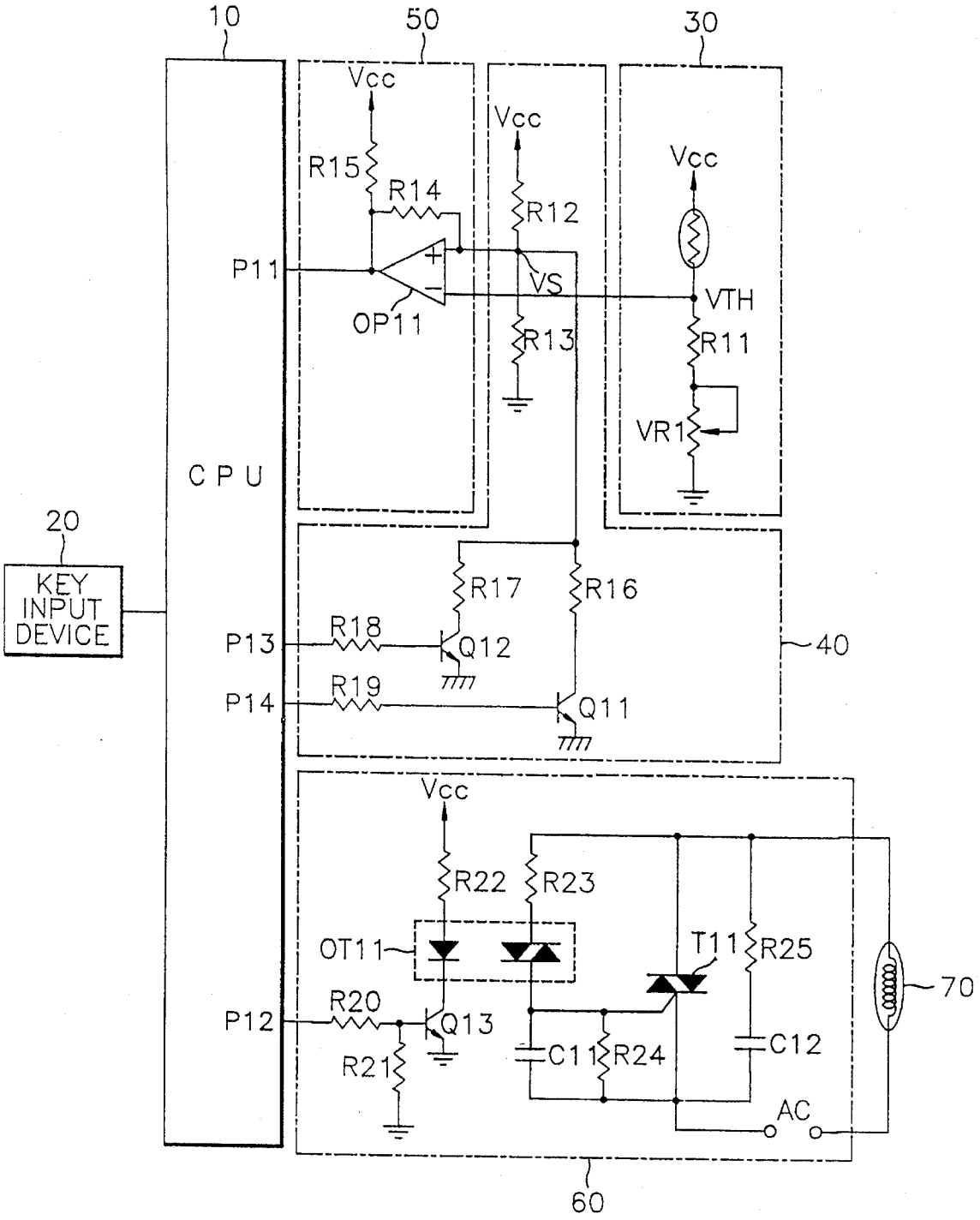
FIG. 5 is a circuit diagram showing an apparatus for controlling fusing temperature according to another embodiment of the present invention.

FIG. 5 is a circuit diagram showing an apparatus for controlling fusing temperature according to another embodiment of the present invention. Key input device 20 generates a key signal for selecting a fusing temperature value out of multiple fusing temperature values in accordance with the thickness of the paper. Temperature detecting device 30 uses a thermistor TH, a resistor R11 and a variable resistor VR1 in serial connection with each other, for generating a temperature sensing voltage $V_{TH}$ representing the detected fusing temperature and consequently any changes in fusing temperature. CPU 10 controls the print operation in response to the print key signal through a predetermined internal program, and generates a fusing temperature control signal for controlling the fusing temperature corresponding to the key signal generated by the key input device 20 and the temperature sensing voltage $V_{TH}$ detected by the temperature detecting device 30. A set temperature convening device 40 responds to the key signal for providing temperature set voltage $V_s$ which represents the correct fusing temperature value corresponding to the thickness of the paper. The set temperature convening device 40 includes resistors R12 and R13 serially connected between a predetermined power supply voltage $V_{cc}$ and a ground, for dividing and outputting a temperature set voltage $V_s$, a resistor R17 serially connected to the connection node of resistors R12 and R13 and a transistor Q12, a resistor R18 connected to a base of the transistor Q12 and a second output port P13 of the CPU 10, a resistor R16 serially connected to a connection node of the resistors R12 and R13 and a transistor Q11, and a resistor R19 connected to a base of the transistor Q11 and a third output port P14 of the CPU 10. Set temperature sensing device 50 is formed with a comparator OP11 and resistors R14 and R15, for comparing the temperature sensing voltage $V_{TH}$ of the temperature sensing device 30 with the temperature set voltage $V_s$ from the set temperature converting device 40 to produce a signal for sensing when the fusing temperature is equivalent to the set temperature. Fusing lamp driving device 60 uses resistors R20 to R22, a phototriac OT11, a transistor Q13, capacitors C11 and C12, and resistors R23 to R25, for driving a fusing lamp 70 in response to the fusing temperature control signal generated by the CPU 10.

Figure 6:
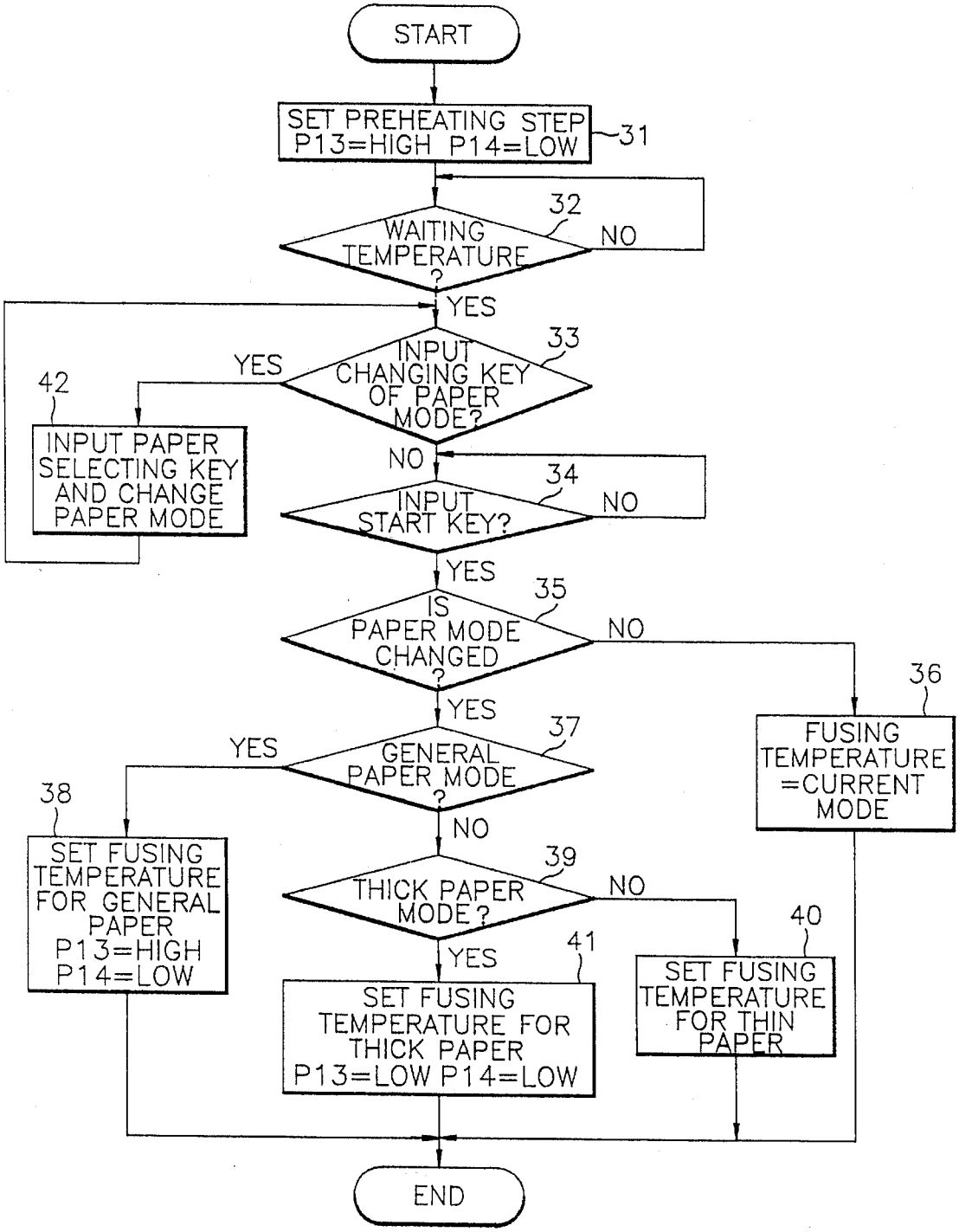
FIG. 6 is a flowchart showing the fusing temperature control process according to another embodiment of the present invention.

FIG. 6 is a flowchart showing the fusing temperature control process according to the embodiment of the present invention represented by FIG. 5.

An operation for controlling a fusing temperature according to the embodiment of the present invention represented by FIG. 5 will be described in detail with reference to FIGS. 5 and 6.

When the initial power is switched on, the CPU 10 establishes a preheating step, at step 31, and outputs a high level signal to the second output port P13 and outputs a low level signal to the third output port P14. Thereafter, the transistor Q11 is turned off, the transistor Q12 is turned on, and the temperature set voltage $V_s$ generated from the connection node of the resistors R12 and R13 becomes a voltage corresponding to a set temperature of the preheating step, equivalent to a waiting temperature. The temperature set voltage $V_s$ is given by the following expression (1):

$$V_s = \frac{R13//R17}{R12 + (R13//R17)} \times V_{cc} \quad (1)$$

The voltage Vs set by the expression (1) above is applied to a positive (+) terminal of the comparator OP11. On the application of initial power, the output of the comparator OP11 becomes a high level. At this time, the CPU 10 outputs a high level signal as the fusing temperature control signal through a first output port P12. Consequently, the transistor Q13 is turned on, and sequentially the phototriac OT11 is turned on. When the phototriac OT11 is turned on, the triac T11 is turned on and the fusing lamp 70 is provided power supply to start heating.

The fusing lamp 70 is continuously heated while the output of the comparator OP11 is high until the temperature sensing voltage arrives at the voltage of expression (1). The thermistor TH and the temperature sensing voltage $V_{TH}$ of the resistor R11 and the variable resistor VR11 increase in accordance with the heating operation of the fusing lamp 70.

At step 32, the CPU determines if a low level signal is produced by comparator OP11 at the first input port P11, indicating the waiting temperature has been obtained. As fusing lamp 70 continues to heat while the temperature set voltage is above the temperature sensing voltage, the fusing temperature raises. As a result, when the temperature sensing voltage $V_{TH}$ becomes higher than the waiting temperature corresponding to the temperature set voltage of expression (1), the output of the comparator OP11 falls to a low level. At this time, the CPU 10 produces a low level fusing temperature control signal via the first output port P12, turning off the transistor Q13. When the transistor Q13 is turned off, the phototriac OT11 and triac T11 are turned off. When the triac T11 is turned off, the heating operation of fusing temperature is stopped because the power supply to the fusing lamp 70 is cut off. Consequently, the system maintains the fusing temperature at the waiting temperature by repeating these steps.

The CPU 10 proceeds to step 33 and selects a predetermined value according to the thickness of the paper indicated via a host computer or key input. At this time, however, the CPU 10 outputs a high level signal to the second output port P13 and outputs a low level signal to the third output port P14, continuously, to sustain the waiting temperature.

In this case, at step 34 when the CPU 10 receives a start key signal from key input device 20 which indicates the start of printing in the waiting state, the printer begins printing. CPU 10 proceeds to step 35 and checks whether a paper mode corresponding to paper thickness is selected. If not selected, the CPU 10 performs the printing operation at the fusing temperature of the current mode indicated at step 36. Otherwise, if the paper mode is selected, the CPU 10 proceeds to step 37 and determines if the selection mode according to the thickness of the paper is a general thickness paper mode. If the selection mode corresponds to the general thickness paper mode, the CPU 10 sets the fusing temperature for general thickness paper by producing a low level signal at the second output port P13 and a high level signal at the third output port P14. Thereafter, the transistor Q12 is turned off, the transistor Q11 is turned on, and the temperature set voltage $V_s$ becomes a set temperature voltage during a normal printing. The set temperature voltage in the general thickness paper mode is given by the following expression (2):

$$V_s = \frac{R13//R16}{R12 + (R13//R16)} \times V_{cc} \quad (2)$$

However, if the selection mode does not correspond to the general thickness mode, at step 39 the CPU 10 determines if the selection mode is a thick paper mod. If the thick paper mode has not been selected, the CPU 10 acknowledges that a thin paper mode is selected. At step 40 a fusing temperature for the thin paper is established, the CPU 10 outputs a high level signal to the second output port P13 and outputs a low level signal to the third output port P14. Therefore, the transistor Q11 is turned off, the transistor Q12 is turned on, and the voltage $V_s$ generated from the connection node of the resistors R12 and R13 becomes a voltage corresponding to the set temperature of a preheating step. The set temperature voltage $V_s$ is given by the following expression (3):

$$V_s = \frac{R13//R17}{R12 + (R13//R17)} \times V_{cc} \quad (3)$$

At step 39, however, if the thick paper mode is selected, the CPU proceeds to step 41. At step 41, to establish a fusing temperature for the thick paper, the CPU 10 produces low level signal at the second output port P13 and produces a low level signal at the third output port P14. Therefore, both transistors Q11 and Q12 are turned off, and the set temperature voltage $V_s$ is given by the following expression (4), the voltage of which is higher than those of the expressions (2) and (3):

$$V_s = \frac{R13}{R12 + R13} \times V_{cc} \quad (4)$$

Consequently, during the printing of the thick paper, the fusing temperature and the heating of the fusing lamp 70 is higher than that of normal printing.

An embodiment of the present invention is made to discriminate the thickness the paper, for which the pressure sensing sensor 108 is connected through the pushing bar 114, to the upper roller 111 of the registration rollers 100 shown in FIG. 3. Instead of registration rollers 100, however, it is possible to determine the thickness of paper in such a way that the pressure sensing sensor 108 is installed in every roller conveying the paper in the same manner as shown in FIGS. 3A and 3B.

Another embodiment of the present invention can control a fusing temperature value having multiple values corresponding to the thickness of a sheet of paper by comparing a temperature sensing voltage $V_{TH}$ which is digital-converted by an analog/digital converter with previously stored value in a memory device.

Furthermore, the present invention is not limited to the above embodiments, but various changes and modifications may be made within the scope not departing from the spirit of the present invention. It is possible, for instance, to control a fusing temperature value having the multi-step value, as a personal computer inputs a signal for setting the fusing temperature value having the multi-step value to a CPU, in a system using an electrophotographic developing process such as a copying machine or laser beam printer.

As is clear from the above description, the present invention is capable of preventing fusing quality from being deteriorated when printing onto thick paper, and preventing a heat roller from starting a fire when printing onto a thin paper, since the thickness of the paper being fed is sensed to thereby control fusing temperature as a set temperature corresponding to the thickness of the paper fed in a system using an electrophotographic developing process.

On the other hand, the present invention is capable of preventing thin paper from being jammed due to heat saturation or from being crumpled, and of preventing toner being spread due to the incompleteness of a fusing operation onto a thick sheet of paper, since a fusing temperature value having a multi-step value is selected in accordance with the thickness of the paper and is controlled.

What is claimed is:

1. An apparatus for controlling a fusing temperature in a system using an electrophotographic developing process, said apparatus comprising:

a fusing lamp for generating heat to execute a fusing operation;

fusing temperature detecting means for detecting the fusing temperature of a heat roller;

sensing means for sensing a thickness of an incoming sheet of paper;

controlling means for controlling said system by:

initializing said system and maintaining said system in a waiting state;

determining whether a print command has been entered by a user;

after said print command has been entered, adjusting the fusing temperature of said heat roller to a reference fusing temperature internally stored in said controlling means, said reference fusing temperature representing the fusing temperature for printing said sheet of paper exhibiting one of a first thickness and a thickness observed from a previous fusing operation;

enabling conveyance of said sheet of paper to said sensing means; and comparing said reference fusing temperature with a corresponding preset temperature for said sheet of paper exhibiting one of first, second and third different thicknesses for enabling printing said sheet of paper after the thickness of said sheet of paper has been sensed by said sensing means, to thereby generate a control signal to control the fusing temperature of said heat roller; and means for driving said fusing lamp to execute said fusing operation in dependence upon said control signal from said controlling means.

2. The apparatus as claimed in claim 1, wherein said paper exhibiting one of said first, second and third different thicknesses respectively represent general, thin and thick paper.

3. An apparatus for controlling a fusing temperature of fusing means in a system using an electrophotographic developing process, said apparatus comprising:

key input means for generating a mode selection signal indicative of a printable medium exhibiting different thicknesses to be printed by said system;

fusing temperature detecting means for detecting the fusing temperature of said fusing means;

controlling means comprising a plurality of preset temperatures for enabling printing of said printable medium exhibiting different thicknesses at different corresponding preset temperatures, for controlling the fusing temperature of said fusing means by sequentially:

preheating said fusing means to a reference fusing temperature representing the fusing temperature for printing said printable medium exhibiting a thickness observed from a previous fusing operation during a waiting state;

determining whether said print command from said key input means has been entered by the user;

determining whether said mode selection signal has been entered by the user after said print command has been entered;

enabling printing of said printable medium with the fusing temperature of said fusing means at said reference fusing temperature, when said mode selection signal has not been entered by the user after said print command has been entered; and determining whether said mode selection signal indicates said printable medium exhibiting one of said different thicknesses to be printed by said system, and adjusting the fusing temperature of said fusing means for enabling printing of said printable medium at a corresponding preset temperature, when said mode selection signal has been entered by the user after said print command has been entered; and means for driving said fusing means under control of said controlling means.

4. A method for controlling a fusing temperature in a system using an electrophotographic developing process, said method comprising the steps of:

initializing said system and preheating heat rollers to set the fusing temperature on a surface of said heat rollers to a reference fusing temperature during a waiting state;

determining whether a paper mode signal has been entered by a user for enabling printing of a printable medium exhibiting one of first, second and third different thicknesses at a corresponding one of first, second and third preset temperatures;

determining whether a print command has been entered by the user to begin said printing of said printable medium;

printing said printable medium exhibiting one of said first, second and third different thicknesses at said reference fusing temperature, when said paper mode signal has not been entered by the user;

determining whether said printable medium exhibits one of said first, second and third thicknesses, when said paper mode signal has been entered by the user;

adjusting said reference fusing temperature preheated on the surface of said heat rollers to a corresponding first preset temperature for enabling printing said printable medium at said first preset temperature when said printable medium exhibits said first thickness;

adjusting said reference fusing temperature preheated on the surface of said heat rollers to a corresponding second preset temperature for enabling printing said printable medium at said second preset temperature when said printable medium exhibits said second thickness; and adjusting said reference fusing temperature preheated on the surface of said heat rollers to a third corresponding preset temperature for enabling printing said printable medium at said third preset temperature when said printable medium exhibits said third thickness; and successively printing a next printable medium based upon a succeeding reference fusing temperature representing the fusing temperature on said surface of said heat rollers from a previous fusing operation after adjusting the preceding reference fusing temperature to a corresponding one of said first, second and third preset temperatures when said next printable medium exhibits one of said first, second and third different thicknesses.

5. In a system using an electrophotographic developing process, a method for controlling a fusing temperature of fusing means for fusing developing material onto a printable medium exhibiting one of first, second and third different thicknesses, said method comprising the steps of:

initializing said system and maintaining said system in a waiting state;

determining whether a print command has been entered by a user;

after said print command has been entered, adjusting the fusing temperature of said fusing means to a reference fusing temperature;

enabling conveyance of said printable medium and making a determination of whether said printable medium exhibits one of said first, second and third different thicknesses;

adjusting said reference fusing temperature of said fusing means to a corresponding one of first, second and third preset temperatures for enabling printing of said printable medium exhibiting one of said first, second and third thicknesses at a corresponding one of said first, second and third preset temperatures in dependence upon said determination; and successively determining whether a next print command has been entered by the user, and enabling printing of a next printable medium exhibiting one of said first, second and third different thicknesses at said corresponding one of said first, second and third preset temperatures based upon a succeeding fusing temperature representing the fusing temperature of a previous fusing operation.

6. The method as claimed in claim 5, wherein said first, second and third thicknesses of said printable medium respectively representing a thin, general and thick printable medium.

7. A method for controlling a fusing temperature of fusing means for fusing developing material onto one of thick, general and thin printable mediums in a system using an electrophotographic developing process, said method comprising the steps of:

determining whether a print command has been input to said system;

setting said fusing means to a reference fusing temperature after said print command has been input, said reference fusing temperature representing the fusing temperature of said fusing means corresponding to one of said general printable medium and a previously fused printable medium;

enabling conveyance of the printable medium into said system after setting said fusing means to said reference fusing temperature; and determining which one of said thick, general and thin printable mediums has been conveyed into said system;

wherein in said determining step, when a general printable medium has been conveyed, said reference fusing temperature of said fusing means is compared with a first preset temperature for said general printable medium and said reference fusing temperature of said fusing means is adjusted to equal said first preset temperature so as to enable printing of said printable medium at said first preset temperature;

when a thin printable medium has been conveyed, said reference fusing temperature of said fusing means is compared with a second preset temperature for said thin printable medium and said reference fusing temperature of said fusing means is adjusted to equal said second preset temperature so as to enable printing of said printable medium at said second preset temperature; and when a thick printable medium has been conveyed, said reference fusing temperature of said fusing means is compared with a third preset temperature for said thick printable medium and said reference fusing temperature of said fusing means is adjusted to equal said third preset temperature so as to enable printing of said printable medium at third preset temperature.

8. In an electrophotographic developing device, a fusing temperature controlling apparatus for controlling a fusing temperature for fusing toner to a sheet of paper having a thickness from one of a plurality of possible thicknesses, said apparatus comprising:

fusing means for fusing said toner to said sheet of paper, wherein said fusing means generates heat at said fusing temperature from one of a plurality of preset fusing temperatures;

fusing temperature detecting means for detecting said fusing temperature of said fusing means;

paper thickness sensing means for determining said thickness of said sheet of paper and generating a paper thickness sensing signal representing said thickness of said sheet of paper; and controlling means for controlling said system by sequentially:

determining whether a print command has been entered;

when said print command has been entered, adjusting said fusing temperature of said fusing means to a reference fusing temperature, said reference fusing temperature representing the fusing temperature for one of said sheet of paper having a general thickness from said plurality of possible thicknesses and said sheet of paper having a thickness observed from a previous fusing operation;

enabling conveyance of said sheet of paper to said paper thickness sensing means;

receiving said paper thickness sensing signal and adjusting said reference fusing temperature of said fusing means in accordance with said paper thickness sensing signal for enabling printing of said sheet of paper having said thickness from one of said plurality of possible thicknesses at a corresponding preset temperature from one of a plurality of preset temperatures;

determining whether a next print command has been entered;

when said next print command has been entered, enabling conveyance of a next sheet of paper to said paper thickness sensing means and printing of said next sheet of paper having a thickness from one of said plurality of possible thicknesses at a corresponding preset temperature from one of said plurality of preset temperatures in dependence upon a succeeding reference fusing temperature representing the fusing temperature of a preceding sheet of paper having a thickness observed from a previous fusing operation.

9. The fusing temperature controlling apparatus as recited in claim 8, wherein said paper thickness sensing means comprises:

a lower roller having a cylindrical outer surface, wherein said lower roller is rotatably mounted at a fixed position;

an upper roller having a cylindrical outer surface, and a rotating axis fixed to said cylindrical outer surface such that said cylindrical outer surface and said rotating axis rotate simultaneously, wherein said cylindrical outer surface of said upper roller is directly above and contacting said cylindrical outer surface of said lower roller at a contacting point and can travel in a vertical direction away from said lower roller and toward said lower roller until said cylindrical outer surface of said upper roller contacts said cylindrical outer surface of said lower roller, such that said sheet of paper is engaged at said contacting point and said upper roller is vertically forced away from said lower roller in accordance with said thickness of said sheet of paper;

a pushing means slidingly attached to said rotating axis of said upper roller, for traveling in said vertical direction with said upper roller and said rotating axis of said upper roller; and a pressure sensing means contacting and responsive to said pushing means, for generating said paper thickness sensing signal representing said thickness of said sheet of paper.

10. The fusing temperature controlling apparatus as recited in claim 8, wherein said plurality of possible thicknesses comprises said general thickness, a thin thickness and a thick thickness and said paper thickness sensing signal represents one of said plurality of possible thicknesses.

11. A fusing temperature controlling apparatus for controlling a fusing temperature for fusing toner to a sheet of paper in an electrophotographic developing device, said apparatus comprising:

fusing means for fusing said toner to said sheet of paper;

fusing temperature detecting means for detecting said fusing temperature of said fusing means;

paper sensing means for sensing location of said sheet of paper and generating a paper sensing signal before said sheet of paper reaches said fusing means;

paper thickness sensing means for determining said thickness of said sheet of paper and generating a paper thickness sensing signal representing said thickness of said sheet of paper; and controlling means for controlling said system by sequentially:

determining whether a print command has been entered;

after said print command has been entered, adjusting said fusing temperature of said fusing means to a reference fusing temperature;

enabling conveyance of said sheet of paper into said system;

determining whether said sheet of paper exhibits one of a general thickness, a thin thickness and a thick thickness;

adjusting said reference fusing temperature to a first preset temperature representing the fusing temperature for said sheet of paper exhibiting said general thickness, and controlling said fusing means to fuse said toner to said sheet of paper at said first preset temperature during printing, when said sheet of paper exhibits said general thickness;

adjusting said reference fusing temperature to a second preset temperature representing the fusing temperature for said sheet of paper exhibiting said thin thickness, and controlling said fusing means to fuse said toner to said sheet of paper at said second preset temperature during printing, when said sheet of paper exhibits said thin paper;

adjusting said reference fusing temperature to a third preset temperature representing the fusing temperature for said sheet of paper exhibiting said thick thickness, and controlling said fusing means to fuse said toner to said sheet of paper at said third preset temperature during printing, when said sheet of paper exhibits said thick paper;

determining whether a print command for a next sheet of paper has been entered; and after said print command for said next sheet of paper has been entered, enabling conveyance of said next sheet of paper into said system, determining whether said next sheet of paper exhibits one of said general thickness, said thin thickness and said thick thickness, and controlling said fusing means to fuse said toner to said next sheet of paper at a corresponding one of said first, second and third preset temperatures during printing in dependence upon a succeeding reference fusing temperature representing the fusing temperature of a previous sheet of paper exhibiting a thickness observed from a preceding fusing operation.

12. The fusing temperature controlling apparatus as recited in claim 11, wherein said paper thickness sensing means comprises:

a lower roller having a cylindrical outer surface, wherein said lower roller is rotatably mounted at a fixed position;

an upper roller having a cylindrical outer surface and a rotating axis fixed to said cylindrical outer surface such that said cylindrical outer surface and said rotating axis rotate simultaneously, wherein said cylindrical outer surface of said upper roller is directly above and contacting said cylindrical outer surface of said lower roller at a contacting point and can travel in a vertical direction away from said lower roller and toward said lower roller until said cylindrical outer surface of said upper roller contacts said cylindrical outer surface of said lower roller, such that said sheet of paper is engaged at said contacting point and said upper roller is vertically forced away from said lower roller in accordance with said thickness of said sheet of paper;

a pushing means slidingly attached to said rotating axis of said upper roller, for traveling in said vertical direction with said upper roller and said rotating axis of said upper roller; and a pressure sensing means contacting and responsive to said pushing means, for generating said paper thickness sensing signal representing said thickness of said sheet of paper.

13. The fusing temperature controlling apparatus as recited in claim 11, wherein said paper thickness sensing signal represents one of said general thickness, said thin thickness and said thick thickness.

14. A fusing temperature controlling apparatus for controlling fusing temperature for fusing toner to a sheet of paper in an electrophotographic developing device said fusing temperature controlling apparatus comprising:

fusing means for fusing said toner to said sheet of paper at said fusing temperature;

controlling means for generating a fusing temperature value signal representing one of the fusing temperature set by a user and the fusing temperature sheet of paper, and for generating a fusing temperature control signal for controlling said fusing temperature of said fusing means;

set temperature converting means responsive to said fusing temperature value signal, for generating a temperature set value from one of a plurality of temperature set values corresponding to a set temperature selected from a plurality of different for said fusing means to fuse said toner to said sheet of paper, said different set temperatures representing said fusing temperature of a plurality of different thicknesses of said sheet of paper;

fusing temperature detecting means for detecting said fusing temperature of said fusing means, and for generating a temperature sensing value representing said fusing temperature of said fusing means; and set temperature sensing means for making a comparison between said temperature set value and said temperature sensing value, and for enabling said controlling means to vary said fusing temperature control signal in dependence upon said comparison to heat said fusing means until said fusing temperature of said fusing means reaches said set temperature.

15. A method of fusing toner to a sheet of paper with a fusing device in an electrophotographic developing system at a fusing temperature selected from one of a plurality of fusing temperatures corresponding to different thicknesses of said paper, said method comprising the steps of:

supplying to said electrophotographic developing system, a sheet of paper exhibiting one of a plurality of possible thickness comprising a high level of thickness, an intermediate level of thickness, and a low level of thickness;

determining whether a print command has been entered;

increasing a fusing temperature of said fusing device to a reference fusing temperature after said print command has been entered, said reference fusing temperature representing the fusing temperature for printing images upon said sheet of paper exhibiting one of said intermediate level of thickness and a level of thickness observed from a previous fusing operation;

determining said thickness of said sheet of paper;

determining whether said reference fusing temperature is below an intermediate fusing temperature for said sheet of paper having said intermediate level of thickness, when said thickness of said sheet of paper is said intermediate level of thickness;

heating said fusing device until the fusing temperature of said fusing device reaches said intermediate fusing temperature, when said thickness of said sheet of paper is said intermediate level of thickness, and said reference fusing temperature is below said intermediate fusing temperature;

fusing said toner to said sheet of paper at said intermediate fusing temperature when said thickness of said sheet of paper is said intermediate level of thickness;

determining whether said reference fusing temperature is below a low fusing temperature for said sheet of paper having said low level of thickness, when said thickness of said sheet of paper is said low level of thickness;

heating said fusing device until the fusing temperature of said fusing device reaches said low fusing temperature, when said thickness of said sheet of paper is said low level of thickness, and said reference fusing temperature is below said low fusing temperature;

fusing said toner to said sheet of paper at said low fusing temperature when said thickness of said sheet of paper is said low level of thickness;

determining whether said reference fusing temperature is below a high temperature for said sheet of paper having said high level of thickness, when said thickness of said sheet of paper is said high level of thickness;

heating said fusing device until said fusing temperature of said fusing device reaches said high fusing temperature, when said thickness of said sheet of paper is said high level of thickness, and said reference fusing temperature is below said high fusing temperature; and fusing said toner to said sheet of paper at said high fusing temperature when said thickness of said sheet of paper is said high level of thickness.

16. The method of fusing toner as claimed in claim 15 in a system comprising a paper thickness sensing device having an upper roller, a lower roller, a pressure bar and a pressure sensing device wherein said step of determining said thickness of said sheet of paper further comprises:

rotating said upper roller and said lower roller in opposite directions of rotation to engage said sheet of paper and convey said sheet of paper between said upper roller and said lower roller;

engaging said sheet of paper with said upper roller and said lower roller;

urging said upper roller away from said lower roller in response to a pressure exerted upon said upper roller from said sheet of paper;

pushing said pressure sensing device with said pressure bar at a pressure equivalent to said pressure exerted upon said upper roller by said sheet of paper; and determining said thickness of said sheet of paper from one of said plurality of possible thicknesses comprising said high level of thickness, said low level of thickness and said intermediate level of thickness from said pressure exerted upon said pressure sensing device.

17. A method of fusing toner to a sheet of paper with a fusing device in an electrophotographic developing system at a fusing temperature selected from one of a plurality of fusing temperatures corresponding to said plurality of possible thicknesses, said method comprising the steps of:

supplying to said electrophotographic developing system, a sheet of paper exhibiting one of a plurality of possible thickness comprising a high level of thickness, an intermediate level of thickness, and a low level of thickness;

preheating said fusing device to a waiting temperature;

maintaining said fusing device at said waiting temperature;

receiving a start printing signal indicating a beginning of a printing operation;

determining a thickness of said sheet of paper and receiving a first predetermined value representing said thickness of said sheet of paper;

determining whether said first predetermined value representing said thickness of said sheet of paper has been received after the beginning of said printing operation;

adjusting said waiting temperature to a first temperature corresponding to said intermediate level of thickness when said first predetermined value has been received and represents said intermediate level of thickness;

adjusting said waiting temperature to a second temperature corresponding to said high level of thickness when said first predetermined value has been received and represents said high level of thickness;

adjusting said waiting temperature to a third temperature corresponding to said low level of thickness when said first predetermined value has been received and represents said low level of thickness;

fusing said toner to said sheet of paper at one of said first, second and third fusing temperatures;

receiving a next start printing signal indicating a beginning of a next printing operation; and successively fusing said toner to a next sheet of paper at the fusing temperature observed from a previous fusing operation after adjusting the fusing temperature to correspond to paper exhibiting one of said high level of thickness, said low level of thickness and said intermediate level of thickness.

18. The method of fusing toner as claimed in claim 17 in a system comprising a paper thickness sensing device having an upper roller, a lower roller, a pressure bar and a pressure sensing device, wherein said step of determining said thickness of said sheet of paper further comprises:

rotating said upper roller and said lower roller in opposite directions of rotation to engage said sheet of paper and convey said sheet of paper between said upper roller and said lower roller;

engaging said sheet of paper with said upper roller and said lower roller;

urging said upper roller away from said lower roller in response to a pressure exerted upon said upper roller from said sheet of paper;

pushing said pressure sensing device with said pressure bar at a pressure equivalent to said pressure exerted upon said upper roller by said sheet of paper; and determining said thickness of said sheet of paper from one of said plurality of possible thicknesses comprising said high level of thickness, said low level of thickness and said intermediate level of thickness from said pressure exerted upon said pressure sensing device.

19. A method for controlling a fusing temperature in a system for printing a printable medium, said method comprising:

initializing said system and preheating a heat roller until said heat roller reaches a reference fusing temperature;

determining whether a print command has been entered by a user to begin said printing of said printable medium exhibiting one of first, second and third thicknesses;

determining whether said printable medium exhibits one of said first, second and third thicknesses after said print command has been entered by the user;

when said printable medium exhibits said first thickness, making a first comparison between said reference fusing temperature and a corresponding first preset temperature, adjusting said reference fusing temperature preheated on a surface of said heat roller in dependence upon said first comparison, and printing said printable medium exhibiting said first thickness at said first preset temperature;

when said printable medium exhibits said second thickness, making a second comparison between said reference fusing temperature and a corresponding second preset temperature and adjusting said reference fusing temperature preheated on the surface of said heat roller in dependence upon said second comparison for printing said printable medium exhibiting said second thickness at said second preset temperature;

when said printable medium exhibits said third thickness, making a third comparison between said reference fusing temperature and a corresponding third preset temperature and adjusting said reference fusing temperature preheated on the surface of said heat rollers in dependence upon said third comparison for printing said printable medium exhibiting said third thickness at said third preset temperature;

printing successive printable media at a succeeding reference fusing temperature representing the fusing temperature on the surface of said heat roller from a preceding fusing operation, when said successive printable media and a preceding printable medium share the same thickness; and alternatively, when said successive printable media exhibit different thickness from said preceding printable medium, determining whether each of said successive printable media exhibits one of said first, second and third thicknesses and adjusting said succeeding reference fusing temperature to correspond to one of said first, second and third preset temperatures for printing each of said successive printable media at a corresponding one of said first, second and third preset temperatures.

20. The method as claimed in claim 19, wherein said first, second and third thicknesses of said printable medium respectively representing a thin, general and thick printable medium.

* * * * *

UNITED STATES PATENT AND TRADEMARK OFFICE

CERTIFICATE OF CORRECTION

PATENT NO. 5,512,992
DATED 30 April, 1996
INVENTOR(S) Seong-Ho Kim, et al.

It is certified that error appears in the above-indentified patent and that said Letters Patent is hereby corrected as shown below:

Column 5 Line 64, after "thickness" insert --paper--;

Column 6 Line 14, after "temperature" change "is over" to --becomes--;

Line 34, before "fusing" [second occurrence] change "detected" to --reference--;

Line 35, before "the" change "is over" to --becomes--;

Line 39, after "enable" change "priming" to --printing--;

Column 15 Line 62, before "sheet" insert --set from a fusing of a preceding--;

UNITED STATES PATENT AND TRADEMARK OFFICE

CERTIFICATE OF CORRECTION

PATENT NO. : 5,512,992
DATED : 30 April, 1996
INVENTOR(S) : Seong-Ho Kim, et al.

It is certified that error appears in the above-indentified patent and that said Letters Patent is hereby corrected as shown below:

Column 16 Line 3, after "different" insert --set temperatures--:

Signed and Sealed this

Twenty-fifth Day of February, 1997

*Attest:*

*Attesting Officer*

BRUCE LEHMAN

*Commissioner of Patents and Trademarks*